US005109683A

United States Patent [19]

Cartwright

[11] Patent Number: 5,109,683

[45] Date of Patent: May 5, 1992

[54] WIND SURFER LOCK

[76] Inventor: Gavin L. Cartwright, Unit 10, 27 Darling Street, South Yarra, Victoria, 3141, Australia

[21] Appl. No.: 471,499

[22] Filed: Jan. 29, 1990

[30] Foreign Application Priority Data

Feb. 1, 1989 [AU] Australia ..... PJ2491

[51] Int. Cl.[5] ..... E05B 73/00

[52] U.S. Cl. ..... 70/14; 70/58

[58] Field of Search ..... 70/58, 14, 18; 114/172, 114/364

[56] References Cited

U.S. PATENT DOCUMENTS

| | | | |
|---|---|---|---|
| 3,091,011 | 5/1963 | Campbell | 280/814 |
| 3,564,632 | 2/1971 | Bahne, Jr. | 441/79 |
| 4,340,376 | 7/1982 | Williams | 70/58 X |
| 4,680,949 | 7/1987 | Stewart | 70/58 X |
| 4,819,462 | 4/1989 | Apsell | 70/14 |

*Primary Examiner*—Lloyd A. Gall

*Attorney, Agent, or Firm*—McGlew & Tuttle

[57] ABSTRACT

The invention relates to a security device for preventing theft of wind surfers. The device comprises first and second members which have projections for locating each member in the mast track of the wind surfer. The first member has a longitudinal section which co-operates with the second member to prevent access to the mast track.

7 Claims, 1 Drawing Sheet

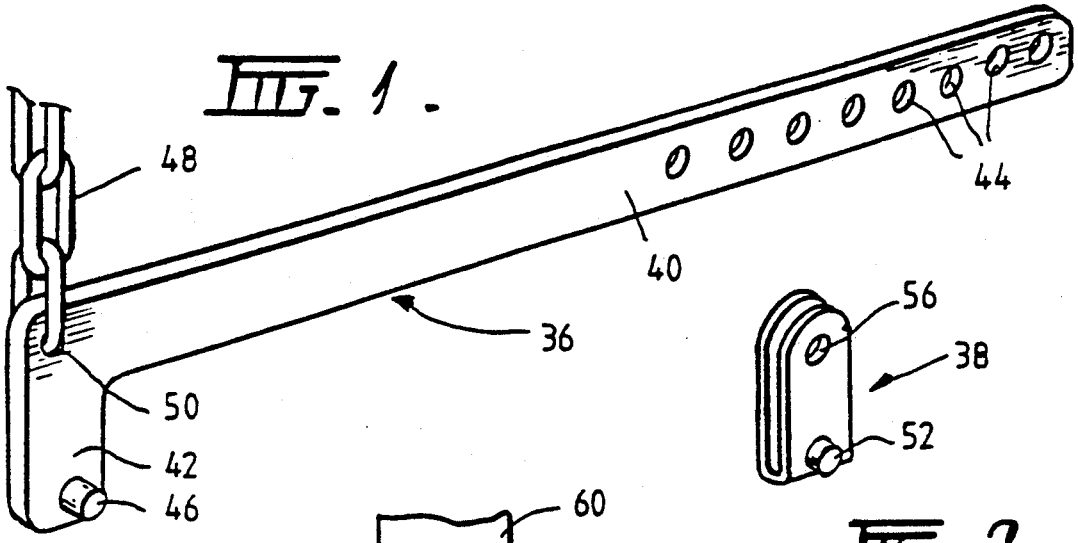
FIG. 1.
FIG. 2.
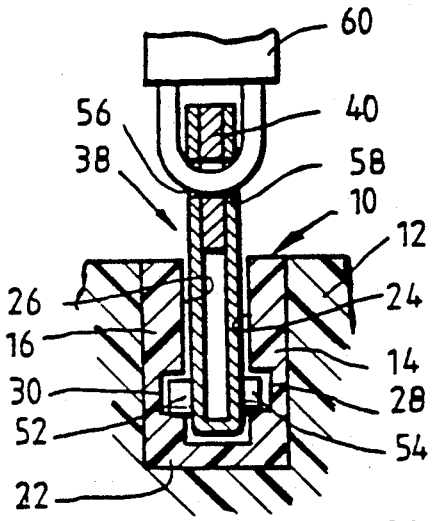
FIG. 5.
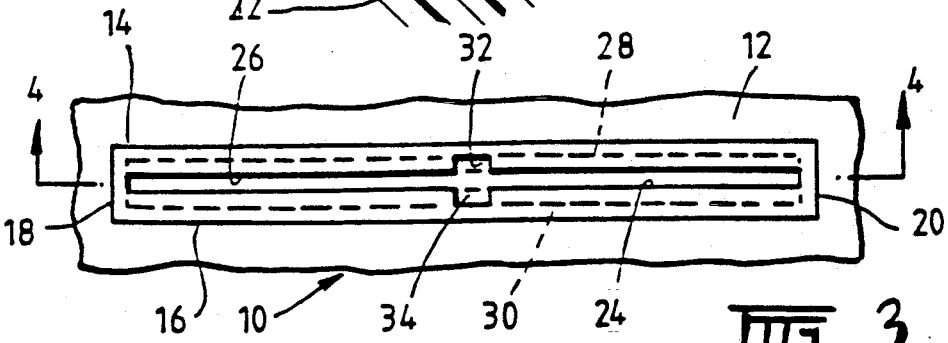
FIG. 3.
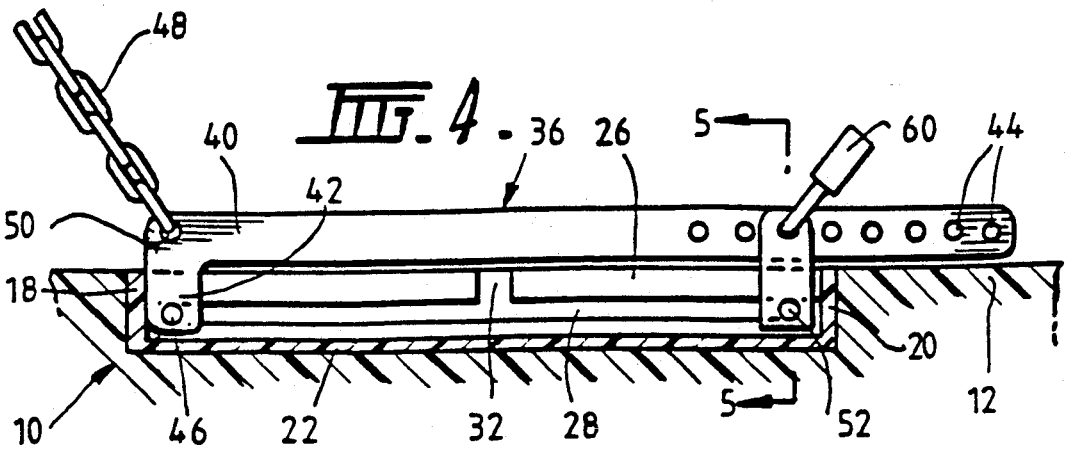
FIG. 4.

WIND SURFER LOCK

FIELD OF THE INVENTION

The present invention relates to a security device for an undercut channel member and relates particularly, although not exclusively, to a security device for mast tracks of wind surfers.

DESCRIPTION OF THE PRIOR ART

Wind surfers are basically a surfboard with a mast and sail. They are expensive and a ready target for thieves. Because of their bulk, wind surfers are usually placed on roof racks of a motor vehicle when being transported to the beach. The board and sail are secured to the roof racks with straps. Such straps can be readily removed, making theft of the wind surfer very easy.

OBJECT OF THE INVENTION

It is an object of the present invention to provide a security device which makes a wind surfer unusable whilst the security device is fitted.

SUMMARY OF THE INVENTION

With this object in view the present invention provides a security device for use in a channel having at least one undercut, said security device including a first member having at least one projection which co-operates with said at least one undercut and is adapted to be slidably located in said channel, said first member including a longitudinal section which is parallel with said channel, and a second member having at least one projection with co-operates with said at least one undercut and is adapted to be slidably located in said channel, said longitudinal section of said first member and said second member including co-operating apertures for reception of a lock.

Preferably said second member includes a U-shaped bracket which receives said longitudinal section therebetween.

In a preferred embodiment said first member is L-shaped with the foot of the L-shaped member containing said at least one projection.

BRIEF DESCRIPTION OF THE DRAWING

In order that the invention may be clearly understood and readily put into practical effect, a preferred non-limitative embodiment of a security device constructed in accordance with the invention will now be described with reference to the accompanying drawings, in which:

FIG. 1 is a perspective view of a first member of a security device made in accordance with the invention;

FIG. 2 is a perspective view of a second member of the security device;

FIG. 3 is a plan view of a mast track on a wind surfer in which the security device of FIGS. 1 and 2 is to be fitted;

FIG. 4 is a cross-sectional view taken along and in the direction of arrows 4—4 of FIG. 3 with the security device fitted; and FIG. 5 is a cross-sectional view taken along and in the direction of arrows 5—5 of FIG. 4.

DESCRIPTION OF THE PREFERRED EMBODIMENT

The preferred embodiment will be described with reference to prevention of theft of wind surfers. As the invention can be used whereever a channel having an undercut is available, the invention is not considered to be limited to its use with wind surfers.

In the drawings there is shown a mast track 10 fitted to a windsurfer board 12. The mast track 10 is a moulded plastics body having longitudinal sides 14, 16; ends 18, 20; and base 22 which form an open ended container or longitudinally extending channel. The inside walls 24, 26 of longitudinal sides 14, 16 are slotted to form undercuts 28, 30 which normally receive the base plate (not shown) from the sail mast (not shown). To allow the base plate to enter undercuts 28, 30 two vertical access channels 32, 34 are provided which are the same depth as undercuts 28, 30. Undercuts 28, 30 may be positioned in any convenient location but it is usually just above base 22. Similarly vertical access channels 32, 34 may be positioned anywhere but it is usually intermediate the length of the mast track. The moulded body 10 forms an integral part of board 12 by being incorporated into the board during production.

The security device of the invention, when fitted to mast track 10, prevents the mast from being attached to board 12. The security device comprises a first member 36 and a second member 38. Both members are preferably made of metal but could be moulded from a tough plastics material. First member 36 has an L-shape with a longitudinal member 40 and foot 42. For adjustability to suit various lengths of mast tracks, a plurality of apertures 44 are provided at the end opposite foot 42. A pin 46 is welded to foot 42 to provide stub axles on either side. For additional security a chain 48 can be secured through aperture 50. In the drawings longitudinal member 40 does not enter mast track 10. By increasing the width of longitudinal member 40 or by adding a depending skirt (not shown) thereto a portion of the longitudinal member will be located within mast track 10. In such a case the board 12 will be damaged if an attempt to hacksaw longitudinal member 40 is made.

The second member 38 is formed as a U-shaped bracket with stub axles 52, 54 on either side of the bracket. Apertures 56, 58 are provided for reception of a lock 60.

In use, stub axles 52, 54 of second member 38 are pushed down vertical access channels 32, 34 until they reach undercuts 28, 30 of the longitudinally extending channel. The member is then displaced rightwardly to the position shown in FIG. 4. The first member 36 has pin 46 similarly inserted into vertical access channels 32, 34 and pushed leftwardly. The free end of longitudinal member 40 is then pivotally swung to be located between the arms of the U-shaped bracket of the second member 38. A lock is then secured to aligned apertures 44, 56, 58 to prevent any access to mast track 10. Chain 48 may, if fitted, also be attached to lock 60 to allow board 12 to be secured to roof racks (not shown) of a vehicle. Any forceable attempts to remove the security device may result in damage to the board. As a damaged board is worthless it is believed that the invention is a very effective theft deterrent.

The preferred embodiment shows the security device co-operating with both undercuts 28 and 30 but a single undercut longitudinally extending channel could also be used. Accordingly, pin 46 need not extend on both sides of foot 42 and one of stub axles 52, 54 could be removed. The shape of first and second members 36, 38 can also be varied to suit requirements.

It is believed that the invention and many of its attendant advantages will be understood from the foregoing description and it will be apparent that various changes may be made in the form, construction and arrangement of the security device described without departing from the spirit and scope of the invention or sacrificing all of its material advantages, the form hereinbefore described being merely a preferred embodiment thereof.

I claim:

1. A security device for use in a longitudinally extending channel having at least one undercut and an access channel communicating with said longitudinally extending channel and said undercut, comprising:

a rigid member including a longitudinal portion and an extension positionable in said longitudinally extending channel; at least one pin element extending from said extension, said at least one pin element being insertable into said access channel, said at least one pin element being movable in said undercut as said extension is moved in said longitudinally extending channel to position said longitudinal portion of said rigid member in a position substantially parallel with said longitudinally extending channel; an independent member; a pin attached to said independent member, said pin being positionable in said access channel, said pin being movable along said undercut as said independent member is moved along said longitudinally extending channel with an end of said independent member extending above said longitudinally extending channel; and means to connect and disconnect said rigid member and said end of said independent member above said longitudinally extending channel.

2. The security device as claimed in claim 1, wherein said independent member includes a U-shaped bracket which receives said longitudinal portion therebetween.

3. The security device as claimed in claim 1 or 2, wherein said rigid member is L-shaped with a foot of the L-shaped member containing said at least one pin element.

4. The security device as claimed in claim 1, wherein each of said rigid and independent members have two opposing pin elements on either side of each member.

5. The security device of claim 1, wherein said longitudinal portion includes a plurality of apertures which cooperate with apertures on said independent member for reception of a lock.

6. The security device of claim 1, wherein a chain or cable is secured to said rigid member to provide a security chain or cable for said device.

7. A security device for wind surfers having a longitudinally extending channel with at least one undercut and a vertical access channel communicating with said longitudinally extending channel and said undercut, comprising:

a rigid member including a longitudinal portion and an extension extending at an angle to said longitudinal portion, said extension being positionable in said longitudinally extending channel; a pin element extending from said extension, said pin element being insertable into said vertical access channel, said pin element being movable in said undercut as said extension is moved in said longitudinally extending channel to position said longitudinal portion of said rigid member in a position substantially parallel with said longitudinally extending channel;

an independent member; a pin attached to said independent member, said pin being positionable in said vertical access channel, said pin being movable along said undercut as said independent member is moved along said longitudinally extending channel with an end of said independent member extending above said longitudinally extending channel; and connection means to connect and disconnect said rigid member relative to said end of said independent member above said longitudinally extending channel, said connection means including a plurality of apertures formed in said longitudinal portion and an aperture formed in said end of said independent member which is alignable with one of said plurality of apertures.

* * * * *